US006179067B1

(12) United States Patent
Brooks

(10) Patent No.: US 6,179,067 B1
(45) Date of Patent: Jan. 30, 2001

(54) METHOD FOR MAGNETIC SURVEY CALIBRATION AND ESTIMATION OF UNCERTAINTY

(75) Inventor: Andrew G. Brooks, Houston, TX (US)

(73) Assignee: Baker Hughes Incorporated, Houston, TX (US)

( * ) Notice: Under 35 U.S.C. 154(b), the term of this patent shall be extended for 0 days.

(21) Appl. No.: 09/329,857

(22) Filed: Jun. 11, 1999

Related U.S. Application Data

(60) Provisional application No. 60/089,100, filed on Jun. 12, 1998.

(51) Int. Cl.[7] ..... E21B 47/022

(52) U.S. Cl. ..... 175/45; 33/304; 702/6

(58) Field of Search ..... 702/6, 1, 10, 11; 175/40, 45; 33/302, 304, 312, 313, 328, 316, 310

(56) References Cited

U.S. PATENT DOCUMENTS

| | | | |
|---|---|---|---|
| 4,682,421 | 7/1987 | van Dongen et al. | 33/302 |
| 4,709,486 | 12/1987 | Walters | 33/304 |
| 4,956,921 | 9/1990 | Coles | 33/304 |
| 5,321,893 | 6/1994 | Engebretson | 33/304 |
| 5,452,518 * | 9/1995 | DiPersio | 33/304 |
| 5,623,407 | 4/1997 | Brooks | 364/422 |
| 5,960,370 * | 9/1999 | Towle et al. | 702/7 |

FOREIGN PATENT DOCUMENTS

| | | | |
|---|---|---|---|
| 0793000 A2 | 9/1997 | (EP) | E21B/47/022 |
| 2 305 250 | 4/1997 | (GB) . | |

* cited by examiner

*Primary Examiner*—Robert E. Pezzuto
(74) *Attorney, Agent, or Firm*—Madan, Mossman & Sriram, P.C.

(57) ABSTRACT

The present invention provides a method for determining magnetometer errors during wellbore survey operations. It is capable of determining errors on up to three axes, with or without the use of an external reference measurement of the local magnetic field, and is capable of providing an accurate result using data from a minimum number of surveys. A model is used to correct the observed data and the corrected data are transformed from the tool coordinate system to a different coordinate system referenced to the earth. The difference between the corrected transformed data and reference data in the earth coordinate system is minimized to determine the model parameters. The present invention also provides a method for determining residual uncertainty in the measurements and for quality control of the measurements. By making the observations over a period of time, any deterioration of the sensors may be identified.

10 Claims, 5 Drawing Sheets

METHOD FOR MAGNETIC SURVEY CALIBRATION AND ESTIMATION OF UNCERTAINTY

CROSS REFERENCES TO RELATED APPLICATIONS

This application takes priority from U.S. Provisional Patent Application Serial No. 60/089,100 filed on Jun. 12, 1998.

BACKGROUND OF THE INVENTION

1. Field of the Invention

Surveying of wellbore orientation is commonly performed by the use of instruments containing sets of three orthogonal accelerometers and magnetometers, which are inserted within the drillstring and used to measure the orientations of the local gravitational and magnetic field vectors. In order to measure the earth's magnetic field, which is used as a north reference from which wellbore azimuth may be computed, the instruments must be placed within a section of non-magnetic material extending between upper and lower ferromagnetic drillstring sections. These ferromagnetic portions of the drillstring tend to acquire magnetization as they are repeatedly strained in the earth's magnetic field during drilling operations. The nominally non-magnetic portion of the drillstring may also acquire some lesser magnetization as a result of imperfections. The result is that magnetometer measurements made by an instrument within a drillstring may measure not the undisturbed magnetic field, but the vector sum of the earth's field and an error field caused by drillstring magnetization. Since the tool is fixed with respect to the drillstring, the error field is fixed with respect to the tool's coordinate system and it appears as bias errors on the magnetometer measurements, which can lead to errors in the determination of wellbore azimuth and trajectory unless measures are taken to compensate for these bias errors.

2. Description of the Prior Art

Since the greater part of the drillstring magnetization occurs in the ferromagnetic portions of the drillstring, which are displaced axially from the instrument, the bias error in the axial direction usually exceeds the transverse bias errors. Various methods have therefore been published which seek to determine axial magnetometer bias errors in a single directional survey, including U.S. Pat. No. 3,791,043 to Russell, U.S. Pat. No. 4,163,324 to Russell, U.S. Pat. No. Re. 33,708 to Roesler, U.S. Pat. No. 4,761,889 to Cobern, U.S. Pat. No. 4,819,336 to Russell, U.S. Pat. No. 4,999,920 to Russell, and U.S. Pat. No. 5,155,916 to Engebretson. All of these methods require the provision of an independent estimate of one or more components of the earth's magnetic field, and as a result all of them tend to lose accuracy in those attitudes in which the direction of the independent estimate is perpendicular to the drillstring and therefore contributes little or no axial information. In particular, all of these methods lose accuracy as the wellbore attitude approaches horizontal east-west. A number of methods have also been published which seek to determine magnetometer biases on all three axes, including U.S. Pat. No. 4,682,421 to van Dongen and U.S. Pat. No. 4,956,921 to Coles, and UK Pat. No. 2,256,492 to Nicolle. While certain of these methods can resolve transverse bias components without external estimates of the field, they all require an independent estimate of the earth's magnetic field in order to determine the axial bias component, and therefore they also tend to lose accuracy as the attitude approaches horizontal east-west.

U.S. Pat. No. 4,709,486 to Walters discloses a method for determining axial bias errors without any external estimate, by the simultaneous use of transverse magnetometer data from a plurality of surveys. However the method fails to make use of the valuable information contained in the axial magnetometer measurements, since it does not require any correlation between the axial biases determined at the plurality of attitudes. In U.S. Pat. No. 5,321,893, Engebretson discloses a method which may be used to determine magnetometer scale factor and bias errors from a plurality of surveys with or without requiring any external estimate of the earth's field. However, the method is inherently approximate since it requires the construction of a "measurement matrix", whose elements depend on the unknown borehole attitude and magnetic dip angle. U.S. Pat. No. 5,623,407 to the present inventor and having the same assignee discloses a method for determining magnetometer biases during wellbore survey operations, which is capable of determining biases on up to three axes, with or without the use of an external estimate of the local magnetic field, and which is capable of providing an accurate result using data from a minimum number of surveys. Also disclosed in U.S. Pat. No. 5,623,407 is a method for determining magnetometer biases which may vary between surveys in a predefined manner. What is lacking in prior art is the ability to deal with biases in the accelerometer and properly correcting for the, and the ability to estimate the uncertainty of correlated measurements.

Additional objectives, features and advantages of the present invention will be apparent in the written description which follows.

SUMMARY OF THE INVENTION

The present invention provides a method for determining magnetometer errors during wellbore survey operations. It is capable of determining errors on up to three axes, with or without the use of an external reference measurement of the local magnetic field, and is capable of providing an accurate result using data from a minimum number of surveys. A model is used to correct the observed data and the corrected data are transformed from the tool coordinate system to a different coordinate system referenced to the earth. The difference between the corrected transformed data and reference data in the earth coordinate system is minimized to determine the model parameters. The present invention also provides a method for determining residual uncertainty in the measurements and for quality control of the measurements. By making the observations over a period of time, any deterioration of the sensors may be identified.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
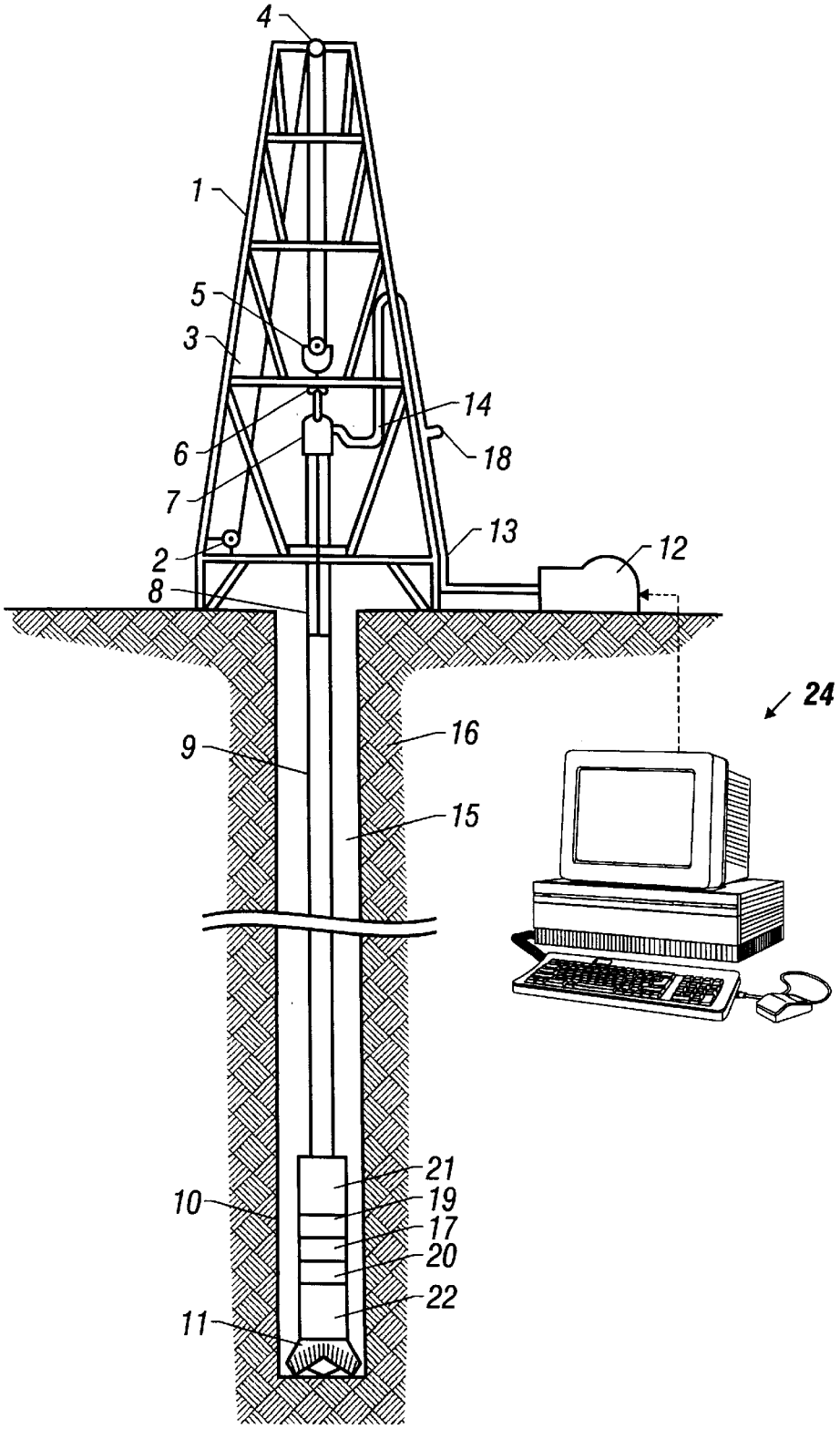
FIG. 1 shows a typical drilling operation comprising a drilling rig, a drillstring including a survey instrument, and a fluid circulating system.

FIG. 1 illustrates a rig engaged in drilling operations; the equipment includes a derrick 1, drawworks 2, cable 3, crown block 4, traveling block 5, and hook 6, supporting a drillstring which includes a swivel joint 7, kelly 8, drillpipe 9, drill collars 10, and drill bit 11. Pumps 12 circulate drilling fluid through a standpipe 13 and flexible hose 14, down through the hollow drillstring and back to the surface through the annular space 15 between the drillstring and the borehole wall 16. During the course of drilling a borehole for oil or gas exploration, it is advantageous to measure from time to time the orientation of the borehole in order to determine its trajectory. This can be accomplished by the use of a survey tool 17 located within the drill collars 10, for measuring the direction and magnitude of the local gravitational and magnetic fields with respect to a tool-fixed coordinate system. It is customary to take one survey each time the drilling operation is interrupted to add a new section to the drilistring; however, surveys can be taken at any time.

Still referring again to FIG. 1, the measured data are transmitted to the surface by modulating a valve (not shown) placed in the flow passage within or adjacent to survey tool 17, causing pressure pulses to propagate in the mud column up the drillstring, where they are detected by a pressure transducer 18 placed in the standpipe 13 and communicated to data processing system 24 which may be located on the rig floor or in a logging trailer or other work area, which is approximately programmed to (1) to interpret the pressure pulses (2) eliminate the influence of magnetic field bias error components and (3) calculate one or more conventional wellbore orientation indicators. Data processing system 24 may be programmed in accordance with the present invention. Other methods and devices for communicating data uphole, such as electromagnetic methods or acoustic signals in the drillstring, could also be used and are intended to be within the scope of the invention.

The borehole inclination can be determined by use of the gravitational measurements alone, while the borehole azimuth is determined from the gravitational and magnetic measurements; since the azimuth uses the direction of the local magnetic field as a north reference, it is necessary for the survey tool 17 to be placed in non-magnetic portions 19 and 20 of the drillstring situated between upper and lower ferromagnetic sections 21 and 22. Magnetization of the upper and lower ferromagnetic sections 21 and 22, as well as imperfections in the non-magnetic materials comprising the survey tool 17 and the non-magnetic collars 19 and 20 can produce a magnetic error field, which is fixed in the tool's frame of reference and which therefore appears as bias errors affecting the magnetic measurements. The present invention is directed to determining these errors in order to compensate for their presence and thus to provide more accurate measurements of borehole azimuth.

Figure 2:
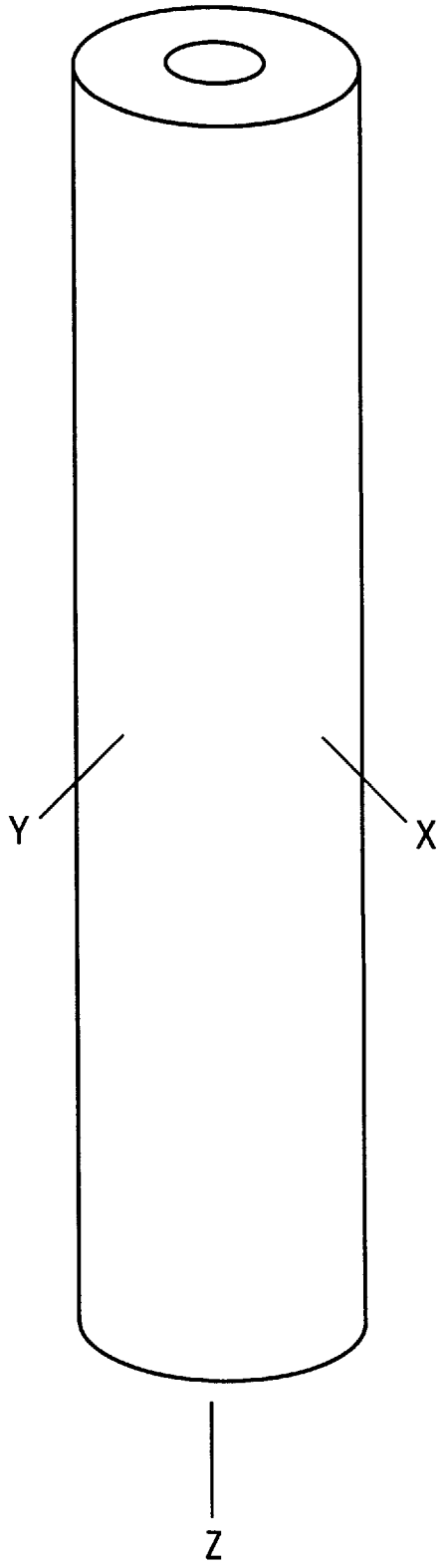
FIG. 2 shows a typical tool-fixed coordinate system used by a magnetic survey instrument located within a drillstring.

The invention will first be described as it pertains to solving for constant bias errors along each axis. It is conventional to define the tool-fixed coordinates as x, y and z, the z-coordinate being aligned with the drillstring axis as illustrated in FIG. 2. The instrument measures three components Gx, Gy and Gz of the gravitational vector G, and three components Bx, By and Bz of the magnetic flux density vector B.

The principal sources of azimuth uncertainty in magnetic surveys are sensor errors, uncertainty in the magnetic declination, instrument misalignment, and drilling magnetization. The overall uncertainty at a bottomhole location tends to be dominated by the declination and magnetization errors, since these are systematic over a group of surveys. Arrays of accelerometers and magnetometers respectively measure the direction of the gravity and magnetic field vectors with respect to the tools x-y-z coordinate frame. The azimuth is then computed as $$A = \arctan\left[\frac{(G_x^2 + G_y^2 + G_z^2)^{0.5} \cdot (B_y \cdot G_x - B_x \cdot G_y)}{B_z \cdot (G_x^2 + G_y^2) - G_z \cdot (B_x \cdot G_x + B_y \cdot G_y)}\right] \tag{1}$$

Accelerometer and magnetometer sensor errors $\epsilon_g$ and $\epsilon_b$ cause the measurements to be imprecise, and the consequent uncertainties in azimuth may be estimated as $$\delta Ag = \epsilon_g \cdot \left[\left(\frac{\partial A}{\partial G_x}\right)^2 + \left(\frac{\partial A}{\partial G_y}\right)^2 + \left(\frac{\partial A}{\partial G_z}\right)^2\right]^{0.5} = \frac{180}{\pi}\frac{\epsilon_g}{G}\left[\frac{B_v^2}{B_h^2} + \frac{1}{\tan^2 I} - 2 \cdot \frac{B_v \cos A}{B_h \tan I}\right]^{0.5} \tag{2}$$

$$\delta Ab = \epsilon_b \cdot \left[\left(\frac{\partial A}{\partial B_x}\right)^2 + \left(\frac{\partial A}{\partial B_y}\right)^2 + \left(\frac{\partial A}{\partial B_z}\right)^2\right]^{0.5} = \frac{180}{\pi}\frac{\epsilon_b}{B_h} \tag{3}$$

where $B_h$ and $B_v$ are the horizontal and vertical components of the local magnetic flux density, and I is the inclination.

The accelerometer and magnetometer errors are uncorrelated, thus the overall azimuth uncertainty due to sensor errors is $$\delta A = (\delta A_g^2 + \delta A_b^2)^{0.5} \tag{4}$$

Incorrect declination values are a primary source of azimuth error in magnetic surveys. One method of avoiding large declination errors is a site survey and in-field referencing to provide local magnetic field parameters in real time.

Another source of errors in survey tools is misalignment of the tool's axis with the borehole, however these azimuth errors are usually small in comparison with the others and their effect tends to be randomized as the toolface angle changes between surveys.

Yet another source of errors arises from the fact that as magnetic drillstring materials are rotated and stressed in the earth's magnetic field, they may develop permanent magnetization. Some components may be magnetized further during inspection and transportation. Magnetic poles are produced close to the ends of each member of the drillstring, although some components may also develop intermediate poles. Each pole produces an error field at the sensor proportional to its pole strength and inversely proportional to the square of its distance from the sensor. The error field seen by the sensor is assumed to be the sum of the contributions from all the poles.

Since magnetic drillstring components are normally spaced at least several meters axially from the sensors, the error fields due to permanent magnetization tend to be closely aligned with the z-axis. The error field therefore appears equivalent to a bias error on the z-magnetometer. A cross-axial bias effect may also be present as a result of off-axis magnetic poles, drillstring bending, or hot spots in nonmagnetic collars, but the cross-axial effect is typically an order of magnitude smaller than axial.

Magnetic drillstring components may exhibit both remanent and induced magnetization. The error field due to induced magnetization is caused by magnetic poles where the flux enters or leaves the more permeable materials; it is proportional to the magnitude of the external field and therefore it appears similar to a magnetometer scale factor error. The induced error field is not necessarily parallel to the external field, thus the apparent scale factor errors may differ among the three magnetometer axes. Experiments have shown that the induced axial magnetization associated with drillstring components is usually small in comparison with the remanent component, and its effect may sometimes be masked by downhole changes in remanent magnetization over a period of time. The error field due to induced magnetization is particularly small near the important horizontal east-west attitudes, as the axial component of the external field then approaches zero.

Conventional magnetic corrections process each survey independently, by assuming the error field to be aligned with the z-axis. The unknown z-component of the flux density leaves a single degree of freedom between the components of the local field.

Figure 3:
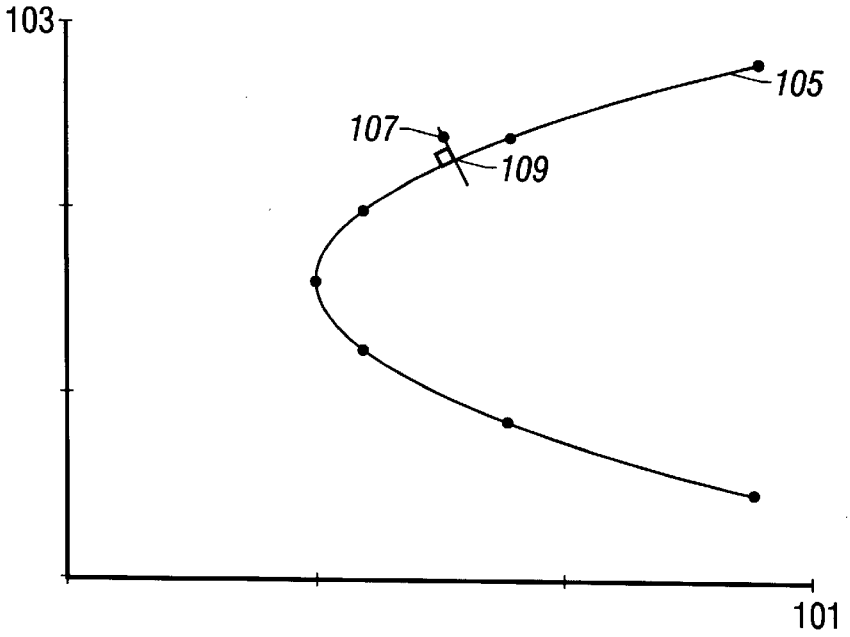
FIG. 3 (PRIOR ART)
FIG. 3 (PRIOR ART) shows the application of conventional methods for the correction of bias errors based upon external field measurements.

A prior art method is illustrated schematically in FIG. 3. The abscissa 101 is the horizontal component of the magnetic field and the ordinate 103 is the vertical component of the magnetic field. Different points along the curve 105 correspond to different biases in the z-component of the gravity measurement and corresponding values of the apparent azimuth of the tool. The equations relating the gravity measurements to the magnetometer measurements are:

$$G_{meas}=(Gx_{meas}^2+Gy_{meas}^2+Gz_{meas}^2)^{0.5}$$

$$B_{meas}=(Bx_{meas}^2+By_{meas}^2+Bz_{meas}^2)^{0.5}$$

$$Bv_{meas}=(Bx_{meas}Gx_{meas}+By_{meas}Gy_{meas}+Bz_{meas}Gz_{meas})/G_{meas}$$

$$Bh_{meas}=(B_{meas}^2-Bv_{meas}^2)^{0.5}$$

The point 107 represents an externally supplied reference field measurement. Methods for obtaining this reference measurements are discussed below. In prior art, the solution is taken as the point 109 on the curve which minimizes the vector distance to the externally-supplied reference field. This point is obtained by dropping a perpendicular from 107 to the curve.

The major problem with prior art corrections of this type is that their accuracy degrades in horizontal boreholes having an east-west orientation. These attitudes are, unfortunately, those in which the drillstring magnetization effects tend to reach a maximum.

The present invention uses data from a number of surveys and explicitly assumes that error components are common to all surveys. Based on this assumption, the variance among apparent local field values is minimized. For example, if a common axial magnetic error component is estimated as a bias $\epsilon_{bz}$, the z-magnetometer measurement of the n-th survey can be corrected by $$Bz_{corr_n}=Bz_{meas_n}-\epsilon_{bz} \tag{5}$$

The vertical and horizontal components of the local magnetic flux density can then be computed by $$Bv_n=\frac{(Bx_n\cdot Gx_n+By_n\cdot Gy_n+Bz_{corr_n}\cdot Gz_n)}{(Gx_n^2+Gy_n^2+Gz_n^2)^{0.5}} \tag{6}$$

$$Bh_n=(Bx_n^2+By_n^2+Bz_{corr_n}^2-Bv_n^2)^{0.5} \tag{7}$$

$Bv_n$ and $Bh_n$ are thus measurements that have been corrected and transformed from the tool coordinate system (x,y,z) to horizontal and vertical coordinates, i.e., an earth-referenced coordinate system. The variance in the corrected transformed measurements over N surveys with respect to reference vertical and horizontal measurements $Bv_{ref}$ and $Bh_{ref}$ is thus $$V=\frac{1}{N-1}\sum_{n=1}^{N}[(Bh_n-Bh_{ref})^2+(Bv_n-Bv_{ref})^2] \tag{8}$$

Those versed in the art would recognize that instead of horizontal and vertical reference data, the reference data could be in any other set of coordinates. Such variations are intended to be within the scope of the invention.

Figure 4:
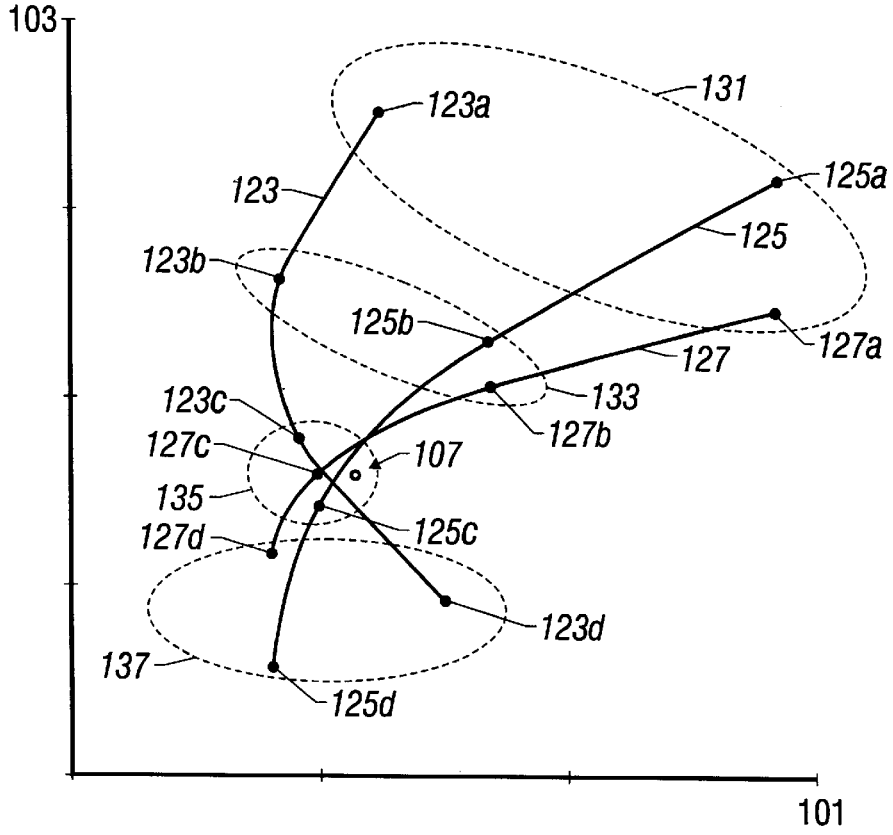
FIG. 4 shows the application of the present invention for correction of errors in multiple surveys.

The method of using multiple surveys is illustrated in FIG. 4, where three surveys are shown, depicted by 123, 125 and 127. The raw data are indicated by the points 123*a*, 125*a* and 127*a*. The data corresponding to one trial value of the z-magnetometer bias $\epsilon_{bz}$ are denoted by 123*b*, 125*b* and 127*b*. Correction with a second trial value of the z-magnetometer bias $\epsilon_{bz}$ are denoted by 123*c*, 125*c* and 127*c* while correction with a third trial value of the magnetometer bias gives the points 123*d*, 125*d* and 127*d*. In this example, the points are grouped most closely about the reference value 107 and the variance is minimized by using trial value 3 (corresponding to zone 135). A bias value close to this is selected as the optimum and the surveys are corrected accordingly.

Since the variance V is nonlinear with respect to $\epsilon_{bz}$, it is minimized by setting $(\delta V/\delta\epsilon_{bz})$ to zero, using an iterative technique such as Newton's method, in which successive approximations to $\epsilon_{bz}$ are obtained by $$\epsilon_{bz}=\epsilon_{bz}-\left(\frac{\partial V}{\partial\epsilon_{bz}}\right)\Big/\left(\frac{\partial^2 V}{\partial\epsilon_{bz}^2}\right) \tag{9}$$

After the iterative process converges to a solution, the residual value of V may be used as a quality indicator and as an input quantity for the calculation of residual uncertainty.

This invention is not limited to solving for a single unknown $\epsilon_{bz}$. It can be extended to solve for any number of unknown parameters, limited only by the number of surveys. The m unknowns are expressed as a vector U, then the solution is obtained by iteration:

$$U=U-\left(\frac{\partial^2 V}{\partial U^2}\right)^{-1}\left(\frac{\partial V}{\partial U}\right) \tag{10}$$

where $(\partial V/\partial U)$ is a vector of length m, and $(\partial^2 V/\partial U^2)$ is a mxm matrix. This is done in the preferred embodiment of the intention.

In one embodiment of the invention, the unknown vector U can contain coefficients applicable to each of the three sensor axes. The unknowns may include not only the magnetometer coefficients, but also accelerometer parameters. In this case, the expression for V is of the form $$V = \frac{1}{N-1}\sum_{n=1}^{N}[(Bh_n - Bh_{ref})^2 + (Bv_n - Bv_{ref})^2] + \frac{1}{(N-1)}\sum_{n=1}^{N} W^2(G_n - G_{ref})^2 \quad (11)$$

where W is a weighting factor relating the measurement units and the residual uncertainties in the G and B fields. The same method may be used for determining biases, scale factors, and misalignments from data obtained during total field calibrations in the laboratory. Since the errors in the magnetic field have no effect on the accelerometer measurements, an alternate embodiment of the invention solves for the accelerometer term alone, i.e., minimizing equation (11) with W having a very large value, and then repeating the minimization using values of the accelerometer parameters to find the magnetometer parameters that minimize equation (8). Coefficients for computing reference magnetic field values for use in equations (8) and (11) are regularly published by agencies such as the British Geologic Survey.

Another embodiment of the invention can be used where there is no independent estimate of the reference field. The reference values in equations (8) and (11) for variance are replaced by mean values. After making the computation, the mean field components provide an estimate of the local field without the need for any external information.

Another embodiment of the invention uses in-field referencing (IFR) or interpolation in-field referencing (IIFR). As would be known to those versed in the art, IFR provides an onsite monitoring of the local magnetic field of the earth and IIFR makes use of monitoring of the magnetic field of the earth at a location away from the wellsite in combination with a single onsite survey. This embodiment makes use of updated three-component reference field values for each survey. Substantial improvement in survey quality is obtained when the correction is combined with IFR or IIFR. By addressing both drilistring interference and declination uncertainty, the two largest contributors to azimuth uncertainty have been reduced.

For subsurface anomalies, or for IIFR applications without a site survey, the present invention can calculate two components of the local flux density, although not the declination. Offsets are added to the reference components in the variance expression, and they are solved as additional elements of the unknown vector U. Specifically, these may be a bias term in the reference field and a bias term in the dip angle. In the case where all three magnetometer scale factor errors are unknowns, a local dip offset can still be determined, although the reference total flux density must then be accepted from an external source. This mode of operation is limited by the assumption that the anomalies are the same for all surveys processed as a group.

Figure 5:
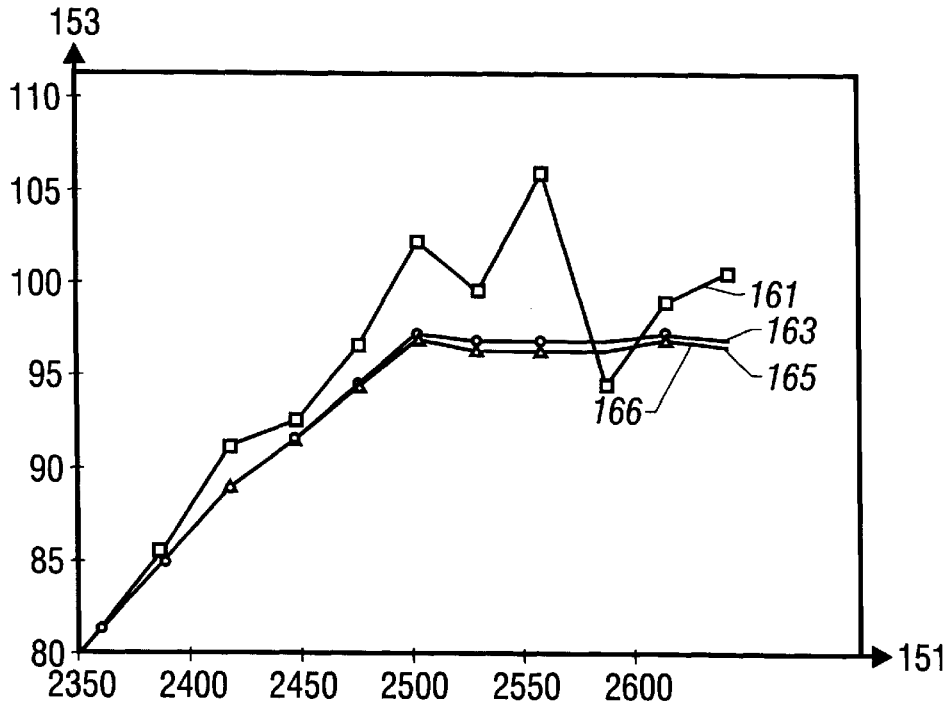
FIG. 5 shows the result of using the present invention on a near horizontal east-west survey.

Unlike conventional corrections, the multiple-survey technique makes use of the z-magnetometer measurements and consequently it can still provide a robust solution in attitudes near horizontal east-west. An example of this is given in FIG. 5. The abscissa 151 is the depth and the ordinate 153 is the determined azimuth. Without using the multiple surveys of the present invention, the results of a prior art, single-survey correction, given by the curve 161 are relatively unstable. Curve 163 corresponds to no correction being made while curve 165 shows corrections with the use of multiple surveys in combination with IIFR. The gap 166 shows a steady difference when curve 165 is compared to the uncorrected curve 163.

Since the computation can identify and correct most of the systematic errors common to all surveys in the set, the residual errors are modeled as random errors or sensor noise. The magnitude of the noise can be estimated from sensor specifications and knowledge of the local field, or it can be estimated more directly from the residual variance V observed in total flux density. The square root of V may be used to approximate the standard deviation σ of the noise on each magnetometer channel. For a three-axis correction, the effect on the solution vector of this level of noise is approximated by the covariance matrix $$C = \left[\sum_{i=1}^{3}\sum_{j=1}^{N}(U_{ij} - U)(U_{ij} - U)^T\right] \quad (12)$$

where $U_{ij}$ is the solution obtained when the 1−σ noise perturbation was applied to the i-th magnetometer channel for the j-th survey, and U is the unperturbed solution. The index i in equation 12 corresponds to the three coordinate axes of the tool while the index j corresponds to the number of surveys. Elements of the normalized covariance matrix (C/V) can be used to indicate matrix condition and stability of the solution. The effect on azimuth at each survey station can be expressed at one standard deviation by $$\delta A = \left[\sum_{i=1}^{3}\sum_{j=1}^{N}(A_{ij} - A)^2\right]^{0.5} \quad (13)$$

where $A_{ij}$ is the azimuth value at that station computed using sensor measurements adjusted by the coefficient vector $U_{ij}$, and A is the azimuth corresponding to U.

Similarly, the uncertainty in the borehole position may be estimated by $$C_r = \left[\sum_{i=1}^{3}\sum_{j=1}^{N}(r_{ij} - r)(r_{ij} - r)^T\right]$$

where $r_{ij}$ is the position vector with components (north, east, vertical) determined using perturbed measurements, and r is the unperturbed value of the position vector.

Figure 6:
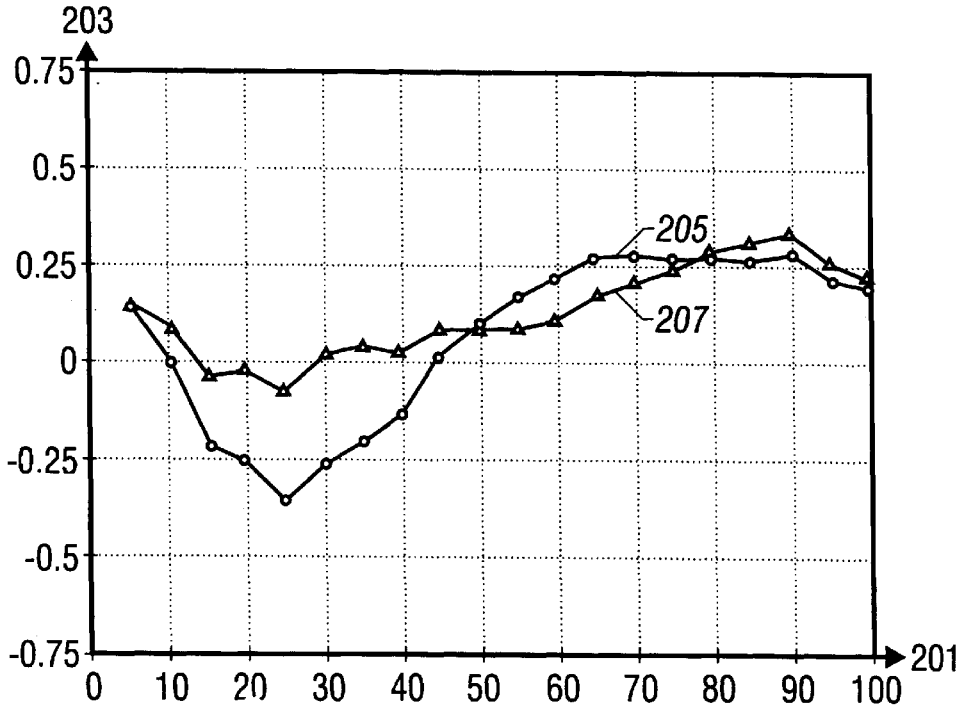
FIG. 6 shows the result of using the present invention on test stand data.

To verify the validity of the method, a magnetic survey probe was placed in a calibrated precision stand in a magnetically clean environment with a reference probe alongside. The stand was then moved through a series of positions with inclinations ranging from near-vertical north to approximately horizontal east, with a wide range of toolface angles. The angles selected are representative of those encountered in a single well, although it is unlikely that a single magnetic survey tool would see such a wide range in a single run. The correction algorithm was used to estimate scale factor and bias values for each accelerometer and magnetometer axis. FIG. 6 shows the results of the comparison. The abscissa 201 is the inclination angle (in degrees) and the ordinate 203 is the error in azimuth determination (in degrees), defined as the difference between the nominal test stand position and the measured angle, obtained with the correction 207 and without the correction 205.

Figure 7:
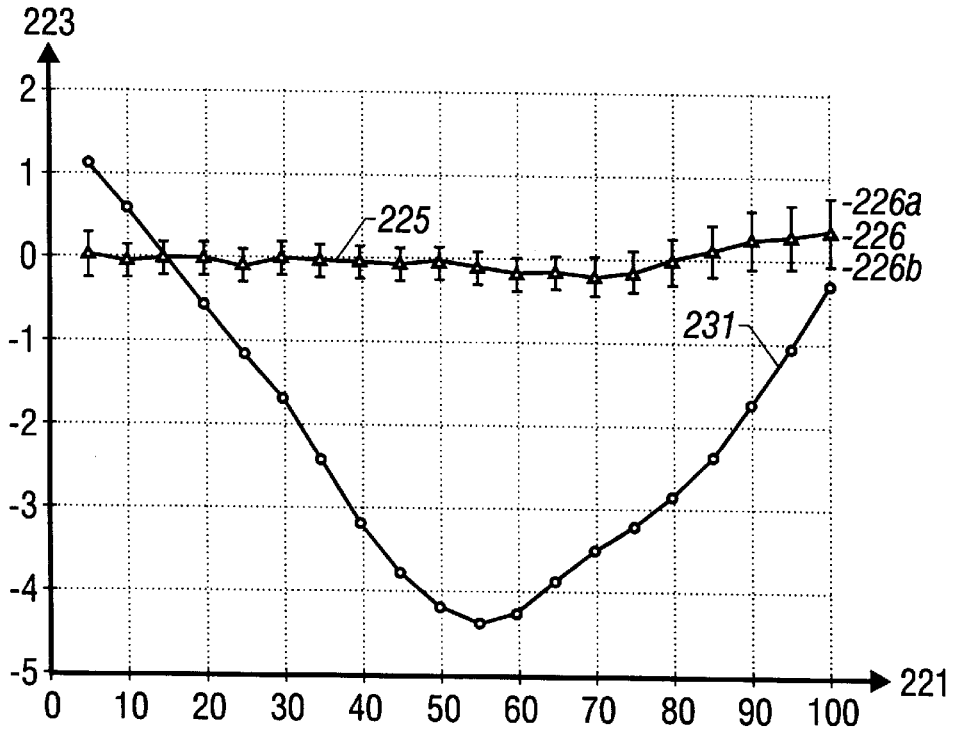
FIG. 7 shows test stand data with magnetization errors.

The ability of the algorithm to reduce effects due to magnetic interference was examined by repeating the experiment, with a socket with unknown magnetization mounted near the bottom end of the probe. The results are depicted in FIG. 7. The abscissa 221 is the inclination of the tool (in degrees) and the ordinate 223 is the error in azimuth (in degrees). The survey 231 shows the results when no correction was applied while the survey 225 shows the results of using the method of the present invention. Also shown in FIG. 7 is the estimated residual uncertainty at the two standard deviation level. This is depicted by the point 226 and the bars extending on either side of the point 226 to the two standard deviation points 226*a*, 226*b*. Application of the correction reduced the maximum azimuth error from more than 4 degrees to less than 0.4 degrees. Processing the raw data with a conventional single survey magnetic correction algorithm produced errors (not shows) in excess of 10 degrees in attitudes near horizontal east-west.

Still referring to FIG. 7, the expected azimuth uncertainty at each station was computed using the residual variance in total gravity field to estimate the standard deviation of the accelerometer errors, then using equation (2) to determine the standard deviation of the azimuth uncertainty due to accelerometer errors. Next, the residual variance in total magnetic flux density was used to find the standard deviation of the magnetometer errors, and equation (13) was used to find the standard deviation of the azimuth uncertainly due to magnetometer errors. The overall azimuth uncertainty was then determined by using equation (4) to combine the uncorrelated accelerometer and magnetometer contributions. In this controlled experiment, the observed residual errors appear to conform well within their predicted values, which are at a ninety-five percent (95%) confidence level.

Since the method can correct for most systematic errors that are correlated between the measurements, the residual errors may be considered to be uncorrelated random errors. Each of these residuals propagates into all of the correlated measurements through errors in the computed coefficients. These errors are important since they can become large in ill-conditioned cases.

The solution to the equations $\partial V/\partial U=0$ can be solved iteratively as indicated in equation (10), and the final variance V gives the noise on the individual recording channels and serves as a quality control check on the data acquisition procedure.

The errors due to M individual measurements can then be combined into a covariance matrix C that describes the overall uncertainty in the computed coefficient vector U by the relation $$C = \sum_{m=1}^{M} (U_m - U)(U_m - U)^T$$

The effect on azimuth at each survey station can be expressed at one standard deviation by equation (13) above.

The quality control (QC) aspect is used to aid post drilling assessment of the magnetic data on a daily basis. In order to exclude unreliable surveys from the data set, user-definable setpoints are used to reject surveys based on excessive departure of their total gravity field, total magnetic field, or dip angle. These setpoints are normally set to values consistent with tool performance as claimed in the position uncertainty model. For surveys which do not pass the setpoints, checkshots can be taken subsequently with the same tool to replace the suspect data.

The calculation algorithm is used with IFR or IIFR techniques to determine apparent calibration coefficients. Trend analysis is then undertaken to establish if there is any apparent deterioration in accelerometer or magnetometer performance, and to verify whether the tool performance is maintained within the specification established at the calibration stage. The trend analysis can be used to advise the operational personnel that, even though the tool may be performing within specification at the moment, consideration should be given to replacing the tool on the next trip out of hole.

Those versed in the art would recognize that any misalignment of sensors in the tool with respect to the tool's (x,y,z) axis would show up in a systematic manner in the determined biases and could be determined by including them in the unknown vector U. The present invention also includes the ability to detect such misalignment.

The drillstring interference effect can be estimated by the change in azimuth introduced by the correction. To provide acceptable surveys without making magnetic corrections, this azimuth change should be less than the uncorrelated statistical sum of the allowable magnetic interference effect as stated in the error model, and the residual uncertainty of the correction, each evaluated at the appropriate confidence level.

As in prior art, the present invention includes the capability for transmitting measurements to the earth's surface utilizing measurement-while-drilling (MWD) transmission techniques. These data may be used by a processor 24 that is preprogrammed in accordance with the methods discussed above. The program includes as inputs the x-, y- and z-components of the local magnetic and gravitational fields at each survey station. The calculations are performed in accordance with the description above, and the processor provides as an output for each survey station the wellbore azimuth and inclination. In an alternate embodiment of the invention, the processor may be downhole, and reference field measurements may be transmitted downhole to the processor.

Figure 8:
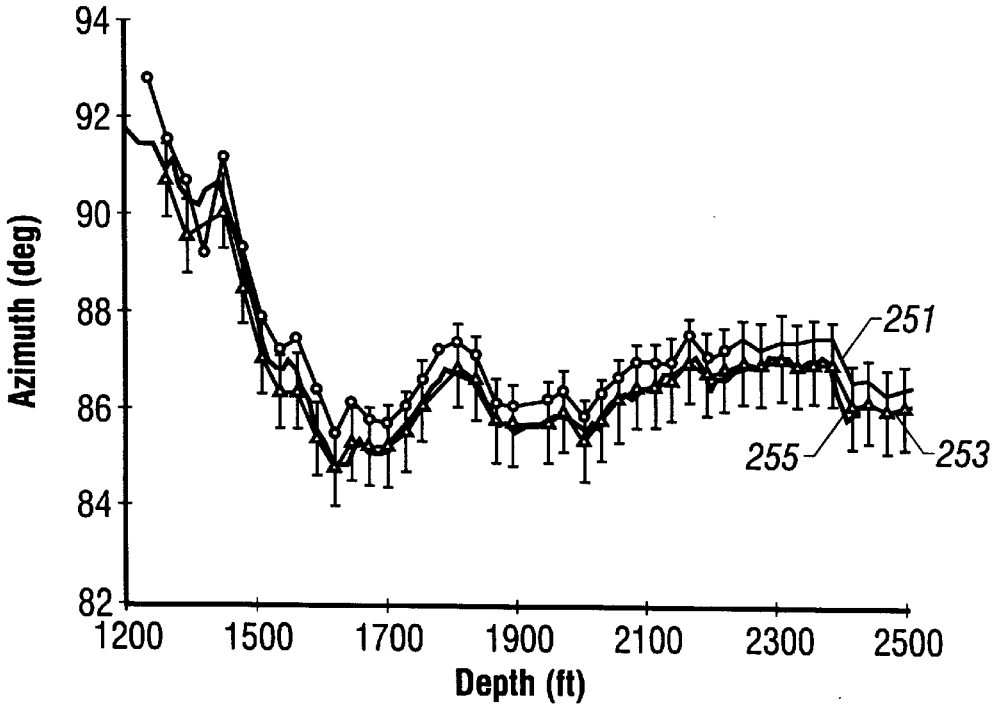
FIG. 8 shows a comparison of the present method with a high accuracy inertial navigation survey.

FIG. 8 is an example of a survey that has been corrected using the multiple survey technique. The results of using the IIFR method alone are shown by the curve 251. The results of using the IIFR method with the present invention are shown by 253 while 255 is the result of an accurate Inertial Navigation Survey in the same borehole. The combination of the IIFR and the multiple survey correction 253 results in azimuth values extremely close to those obtained from a high accuracy inertial navigation tool 255. In this case, the computed residual uncertainty, depicted by the error bars on curve 253 appears to be conservative when compared to the azimuth difference between the magnetic and inertial tools.

The present intention is illustrated by way of the foregoing description, and various modifications will be apparent to those skilled in the art. It is intended that all such variations be within the scope and spirit of the appended claims.

What is claimed is:

1. A method of correcting magnetic and gravitational measurement errors during drilling of a wellbore, comprising:

(a) obtaining a plurality of magnetic and gravitational measurements at selected locations in said wellbore;

(b) using a model comprising a set of model parameters for correcting values of said plurality of magnetic and gravitational measurements and producing therefrom a plurality of corrected magnetic and gravitational measurements;

(c) performing a coordinate transformation of the plurality of corrected magnetic and gravitational measurements to give a plurality of transformed corrected magnetic and gravitational measurements;

(d) defining a measure of a difference between the plurality of transformed corrected measurements and reference values of magnetic and gravitational measurements;

(e) determining values for the set of model parameters that minimize the measure of difference giving a minimized residual; and (f) using the determined values of the model parameters and the minimized residual for obtaining a quantitative estimate of the accuracy of one or more of the plurality of magnetic and gravitational measurements.

2. The method of claim 1 wherein the plurality of magnetic and gravitational measurements are sent by telemetry to a surface processor and the surface processor is adapted to perform steps (b), (c), (d) and (e).

3. The method of claim 1 further comprising obtaining a quantitative estimate of the accuracy the determination of at least one of (i) an azimuth at said selected locations, and, (ii) a position of the borehole at said selected locations.

4. The method of claim 1 wherein the model includes one or more parameters selected from (i) a bias in at least one component of the gravity measurements, (ii) a bias in at least one component of the magnetic measurements, (iii) a scale factor for the gravity measurements, (iv) a scale factor for the magnetic measurements, (v) a misalignment of a sensor making the gravity measurements, and (vi) a misalignment of sensor making the magnetic measurements.

5. The method of claim 1 wherein determining the model parameter includes one or more parameters selected from (i) a bias in at least one component of the gravity measurements, (ii) a scale factor for the gravity measurements, and, (iii) a misalignment of a sensor used to make the gravity measurements, to give a subset of determined model parameters, the method further comprising using the subset of determined model parameters to obtain additional model parameters selected from (A) a bias for at least one component of the magnetic measurements(B) a scale factor for the magnetic measurements, and (C) a misalignment of a sensor used for making the magnetic measurements.

6. The method of claim 1 further comprising providing an onsite monitoring of the local magnetic field of the earth to give said reference values.

7. The method of claim 1 further comprising monitoring the magnetic field of the earth at a location away from the wellsite to give said reference values.

8. The method of claim 1 wherein said reference values further comprise at least one independent measurement selected from (i) a component of the gravitational field, and (ii) a component of the magnetic field.

9. The method of claim 1 wherein said reference values are averages of said plurality of said transformed corrected measurements.

10. The method of claim 1 further comprising determining a variation in the values for the set of model parameters over a period of time to determine any deterioration in sensors making the plurality of measurements.

* * * * *